US007695884B2

(12) United States Patent
Vanbesien et al.

(10) Patent No.: US 7,695,884 B2
(45) Date of Patent: Apr. 13, 2010

(54) TONER COMPOSITIONS AND PROCESSES

(75) Inventors: Daryl W. Vanbesien, Burlington (CA); Guerino G. Sacripante, Oakville (CA); Michael S. Hawkins, Cambridge (CA); Peter J. G. Rehbein, Woodlawn (CA)

(73) Assignee: Xerox Corporation, Norwalk, CT (US)

( * ) Notice: Subject to any disclaimer, the term of this patent is extended or adjusted under 35 U.S.C. 154(b) by 314 days.

(21) Appl. No.: 11/839,135

(22) Filed: Aug. 15, 2007

(65) Prior Publication Data

US 2009/0047593 A1 Feb. 19, 2009

(51) Int. Cl.
*G03G 9/093* (2006.01)

(52) U.S. Cl. ..... 430/110.2; 430/137.14

(58) Field of Classification Search ..... 430/110.2, 430/137.14
See application file for complete search history.

(56) References Cited

U.S. PATENT DOCUMENTS

| | | | | |
|---|---|---|---|---|
| 4,473,628 | A * | 9/1984 | Kasuya et al. | 430/109.1 |
| 2007/0166636 | A1 * | 7/2007 | Daimon et al. | 430/109.3 |
| 2007/0224532 | A1 * | 9/2007 | Vanbesien et al. | 430/108.22 |
| 2009/0035686 | A1 * | 2/2009 | Sacripante | 430/110.2 |

OTHER PUBLICATIONS

U.S. Appl. No. 11/556,926 filed on Nov. 6, 2006, in the name of Guerino Sacripante et al.
U.S. Appl. No. 11/729,748 filed on Feb. 29, 2007, in the name of Ke Zhou et al.

* cited by examiner

*Primary Examiner*—John L Goodrow
(74) *Attorney, Agent, or Firm*—Oliff & Berridge, PLC

(57) ABSTRACT

An emulsion aggregation toner including a core and a shell wherein the core includes an amorphous polyester, a wax, a crystalline polyester and an optional colorant and wherein the shell includes an amorphous polyester and a wax and is substantially free of crystalline polyester.

17 Claims, No Drawings

TONER COMPOSITIONS AND PROCESSES

TECHNICAL FIELD

This disclosure is generally directed to toner processes, and more specifically, emulsion aggregation (EA) processes, as well as toner compositions formed by such processes. More specifically, this disclosure is directed to EA toner particles comprising a core composed of amorphous polyester, crystalline polyester and an optional colorant, and a shell formed thereon of amorphous polyester and substantially free of crystalline polyester.

BACKGROUND

The present disclosure is generally directed to toner processes, and more specifically to processes comprising aggregating and coalescing toner particles from an aqueous suspension of colorant, wax particles and resin particles. In embodiments, described is the preparation of an ultra low melt polyester toner comprised of colorant, wax, an amorphous resin and a crystalline resin. Ultra low melt particles typically display a melting point of from about 50° C. to about 100° C.

EA techniques typically involve the formation of a latex emulsion of the resin particles, which particles have a size of from about 5 to about 500 nanometers in diameter. The resin may be heated, optionally with solvent if needed, in water, or by making a latex in water using emulsion polymerization. A colorant dispersion, for example of a pigment dispersed in water, optionally also with additional resin, may be separately formed. The colorant dispersion may be added to the emulsion latex mixture and an aggregating agent or complexing agent may then be added to initiate aggregation of larger size toner particles. Once a desired toner particle size is achieved, aggregation may be stopped. The aggregated toner particles may then be heated to enable coalescing/fusing, thereby achieving aggregated, fused toner particles.

Fundamental to the performance of a toner is its ability to maintain charge requirements. The ambient environment, which has been classified into three zones, can affect this ability. The A-zone is characterized by high humidity and high temperature (about 28° C. and about 85% relative humidity). The B-zone is characterized by moderate humidity and temperature (about 21° C. and about 40% relative humidity). The C-zone is characterized by low temperature and low humidity (about 10° C. and about 40% relative humidity). If there is a large difference in charging behavior across these zones, the materials have a sensitivity to relative humidity. The sensitivity ratio may be expressed as a ratio of a triboelectric charge of the toner developer in the C-zone to a triboelectric charge of the toner developer in the A-zone. A goal is for the RH sensitivity ratio to be as close to one as possible.

Polyester based toners may display low charge due to polyester's hydrophilic nature as compared to other toners. With additives, the polyester resins can meet the charge requirements of a toner.

An advantage to using polyester-based toners is the ability to produce low melting toner, for example ultra-low melt toner, via inclusion of crystalline polyester in the toner. However, when a crystalline component is added to these resins to lower the melting point of the toner, the present inventors have found that the high resistivity of the crystalline polyester may contribute to lower charge and lower charge maintainability as well as higher cohesion if coalesced at temperatures above the onset of melt point of the crystalline resin, wherein plasticization of the resin occurs.

Following discovery of these issues, the inventors sought a solution to these potential problems associated with the use of crystalline polyester.

SUMMARY

Thus, what is desired is an EA polyester toner that has a low melting temperature, while addressing one or more of the above problems and thus that can achieve excellent print quality and stable xerographic charging and that has an RH sensitivity ratio from about 1 to about 2, in all ambient environments.

In embodiments, the toner is an emulsion aggregation polyester toner comprising a core portion and a shell portion, wherein the core portion comprises an amorphous polyester and a crystalline polyester, and wherein the shell portion comprises an amorphous polyester and is substantially free of crystalline polyester.

In embodiments, described is a process for forming particles, comprising generating a first emulsion of an amorphous polyester, generating a second emulsion of crystalline polyester, combining the emulsions, aggregating a core particle, and adding more amorphous polyester to form a shell on the core.

In further embodiments, a wax is included in the core and/or shell, for example via an amorphous polyester-wax emulsion.

EMBODIMENTS

The EA toner composition disclosed herein is formed of a core and a shell. The core portion of the toner particles includes at least one amorphous polyester, at least one crystalline polyester, an optional wax, an optional colorant, and an optional coagulant. The shell portion of the toner particles includes at least one amorphous polyester and is substantially free of crystalline polyester.

The inventors found that inclusion of a shell substantially free of crystalline polyester allows the toner to realize the benefits of using crystalline polyester, while substantially avoiding one or more of the above potential problems with the use of crystalline polyester.

In embodiments, the core portion and shell portion of the toner particles may include at least one amorphous polyester resin. Illustrative examples of amorphous polymer resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(propoxylated bisphenol-fumarate), poly(propoxylated bisphenol-succinate), poly(propoxylated bisphenol-adipate), poly(propoxylated bisphenol-glutarate), SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), mixtures thereof and the like. The resins may also be functionalized, such as being carboxylated, sulfonated, or the like, such as sodio sulfonated.

The amorphous resins may be linear or branched, and are available from a number of sources. The amorphous resin may possess various onset glass transition temperatures (Tg) of from about 40° C. to about 80° C., such as from about 50° C. to about 70° C., as measured by differential scanning calorimetry (DSC). The linear and branched amorphous polyester resins, in embodiments, may possess a number average molecular weight (Mn), as measured by gel permeation chromatography (GPC), of from about 10,000 to about 500,000, such as from about 5,000 to about 250,000; a weight average molecular weight (Mw) of from about 20,000 to about 600,000, such as from about 7,000 to about 300,000, as determined by GPC using polystyrene standards; and a molecular weight distribution (Mw/Mn) of from about 1.5 to about 6, such as from about 2 to about 4.

The amorphous resin may be present in the toner composition in amounts of from about 35 to about 90 weight percent, such as from about 60 to about 85 weight percent. This includes, for example from about 40 to about 80 weight percent, such as from about 45 to about 70 weight percent, of the core and from about 90 to about 100 weight percent, such as from about 95 to about 100 weight percent of the shell.

The linear amorphous polyester resins suitable for use herein may be prepared by the polycondensation of an organic diol, a diacid or diester, and a polycondensation catalyst.

In embodiments, an amorphous polyester resin, for example a polypropoxylated bisphenol A fumarate polyester, may be prepared in the continuous process of the present disclosure and then utilized to form a toner composition. Bisphenol A, propylene oxide or propylene carbonate and fumaric acid would be utilized as monomeric components in the process of the present disclosure while a propoxylated bisphenol A fumarate may be utilized as a seed resin to facilitate formation of the latex. A linear propoxylated bisphenol A fumarate resin which may be utilized as a seed resin is available under the trade name SPARII from Resana S/A Industrias Quimicas, Sao Paulo Brazil. Other propoxylated bisphenol a fumarate resins that are commercially available include GTUF and FPESL-2 from Kao Corporation, Japan, and EM181635 from Reichhold, Research Triangle Park, N.C. and the like.

Examples of diacids or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester may be used in amounts such as from about 40 to about 55, such as from 45 to about 52, mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected can vary, and may be from about 40 to about 55, such as from about 45 to about 52, mole percent of the resin.

For the branched amorphous sulfonated polyester resin, the same materials may be used, with the further inclusion of a branching agent such as a multivalent polyacid or polyol. Branching agents suitable for use in forming the branched amorphous polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent may be used in an amount of from about 0.1 to about 8 mole percent such as from about 0.1 to about 5 mole percent, of the resin.

The amorphous polyester of the core and the shell may be the same or different amorphous polyester. Desirably, the amorphous polyester of the core and shell is the same.

In addition to the polyester binder resin, the core portion and shell portion of the toner particles disclosed herein may contain at least one wax. A single wax may be added to the toner formulations to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, functionalized waxes and the like. Examples of natural vegetable waxes include carnauba wax, candelilla wax, Japan wax, bayberry wax and the like. Examples of natural animal waxes include beeswax, punic wax, lanolin, lac wax, shellac wax, spermaceti wax and the like. Mineral waxes include paraffin wax, microcrystalline wax, montan wax, ozokerite wax, ceresin wax, petrolatum wax, petroleum wax and the like. Synthetic waxes include Fischer-Tropsch wax, acrylate wax, fatty acid amide wax, silicone wax, polytetrafluoroethylene wax, polyethylene wax and polypropylene wax, mixtures thereof and the like. Examples of functionalized waxes include amines, amides, imides, esters, quaternary amines, carboxylic acids, and acrylic polymer emulsion, for example, JONCRYL 74, 89, 130, 537, and 538, all available from Johnson Diversey, Inc., chlorinated polypropylenes and polyethylene commercially available from Allied Chemical and Petrolite Corporation and Johnson Diversey, Inc., mixtures thereof and the like.

In embodiments, further examples of suitable waxes include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. Polyethylenes suitable for use herein may possess a Mw of from about 1,000 to about 1,500, while the commercially available polypropylenes utilized have a Mw of about 4,000 to about 5,000.

In addition, in embodiments, the wax may be selected such that the wax does not plastify the amorphous resin during solvent flashing, where the glass transition temperature of an amorphous polyester resin is substantially lowered. That is, the wax and resin mixture should exhibit separate melting and/or Tg peaks in the DSC (differential scanning calorimetry) plot.

The toners may contain at least one wax in any amount of from about 2 to about 15 percent by weight of the core, such as from about 3 to about 12, or from about 4 to about 10 percent by weight of the core. The toners may also contain the at least one wax in any amount of from about 0 to about 8 percent by weight of the shell, such as from about 0 to about 6, or from about 0 to about 5 percent by weight of the shell.

According to embodiments, the amorphous resin and wax are incorporated into the toner composition together, in the form of a single dispersion. The combined resin and wax dispersion may be made by solvent flashing the wax and resin particles, to emulsify the resin and wax to a sub-micron size. That is, to incorporate the wax into the toner formulation with reduced or substantially no surfactant, the wax may be first mixed with all or part of the resin component, in the weight ratio desired in the final toner formulation, prior to addition to the emulsion from which particles are aggregated. Although the resin may be either the amorphous resin or crystalline resin, desirably the resin is the amorphous resin. The wax and resin are dissolved in a suitable organic solvent under conditions that allow a solution to be formed. After the wax and resin are dissolved in the solvent, the resin and wax solution is mixed into an emulsion medium, such as water or deionized water containing a stabilizer, and optionally a surfactant. After the stabilizer or stabilizers are added, the resultant mixture can be mixed or homogenized for any desired time.

Next, the mixture is heated to flash off the solvent, that is, a solvent flash step is conducted, and then the mixture is cooled to room temperature, approximately 22-27° C. For example, the solvent flashing can be conducted at any suitable temperature above the boiling point of the solvent in water that will flash off the solvent, such as about 55° C. to about 120° C., such as from about 60° C. to about 110° C. or from about 65° C. to about 100° C., although the temperature may be adjusted based on, for example, the particular wax, resin, and solvent used.

To facilitate formation of the amorphous resin and wax emulsion, the wax should be soluble in the solvent, and at the temperature used to dissolve the resin for solvent flashing. If these properties are not met, then the resin and wax emulsion may not be formed in the solvent flashing process. One skilled in the art will be able to readily determine or test specific waxes, in combination with specific resins and specific solvents, for their adequacy.

Suitable solvents that can be used include those in which the resin and wax are soluble, and that dissolve the resin and wax components to form an emulsion. The solvent must be capable of being subsequently flashed off to leave the resin and wax in an emulsion, such as in water, at the desired particle size. For example, suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. If desired or necessary, the wax and resin can be dissolved in the solvent at an elevated temperature, such as from about 40° C. to about 90° C. or from about 45° C. to about 85° C. or from about 50° C. to about 80° C. In embodiments, the wax and resin are dissolved in the solvent at an elevated temperature, but below the boiling point of the solvent, such as from about 2° C. to about 15° C. or from about 5° C. to about 10° C. below the boiling point of the solvent. After the wax and resin are dissolved in the solvent, the resin and wax solution is mixed into an emulsion medium, for example water such as deionized water containing a stabilizer.

Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When a stabilizer is used in the composition, it is typically present at a level of from about 0.1 to about 5 percent, such as from about 0.5 to about 3 percent by weight of the wax and resin. When stabilizers are added to the composition, the stabilizers should be essentially free of zinc and other incompatible metal ions, for example, Ca, Fe, Ba, etc., which form water-insoluble salts. The term "essentially free" refers, for example, to the incompatible metal ions as present at a level of less than about 0.01 percent, such as less than about 0.005 or less than about 0.001 percent by weight of the wax and resin. If desired or necessary, the stabilizer can be added to the emulsion of solvent, wax, resin, and deionized water at ambient temperature, or it can be heated to the temperature of the mixture of amorphous resin, wax, solvent and deionized water prior to addition.

Following the solvent flash step, the polyester resin and wax particles in embodiments have an average particle diameter in the range of about 100 to about 500 nanometers, such as from about 130 to about 300 nanometers, as measured with a Honeywell MICROTRAC® UPA150 particle size analyzer.

In embodiments, the amount of wax in the polyester resin and wax mixture is from about from about 3 to about 20 weight percent, such as from about 5 to about 15 weight percent of the polyester resin and wax mixture.

The core portion of the toner particles further includes at least one crystalline polyester resin. Examples of crystalline polyester resins include poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(ododecylene-adipate), poly(ethylene-glutarate), poly(propylene-glutarate), poly(butylene-glutarate), poly(pentylene-glutarate), poly(hexylene-glutarate), poly(octylene-glutarate), poly(nonylene-glutarate), poly(decylene-glutarate), poly(undecylene-glutarate), poly(ododecylene-glutarate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(ododecylene-succinate), poly(ethylene-pimelate), poly(propylene-pimelate), poly(butylene-pimelate), poly(pentylene-pimelate), poly(hexylene-pimelate), poly(octylene-pimelate), poly (nonylene-pimelate), poly(decylene-pimelate), poly(undecylene-pimelate), poly(ododecylene-pimelate), poly (ethylene-sebacate), poly(propylene-sebacate), poly (butylene-sebacate), poly(pentylene-sebacate), poly (hexylene-sebacate), poly(octylene-sebacate), poly (nonylene-sebacate), poly(decylene-sebacate), poly (undecylene-sebacate), poly(ododecylene-sebacate), poly (ethylene-azelate), poly(propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(ododecylene-azelate), poly(ethylene-dodecanoate), poly(propylene-dodecanoate), poly(butylene-dodecanoate), poly (pentylene-dodecanoate), poly(hexylene-dodecanoate), poly (octylene-dodecanoate), poly(nonylene-dodecanoate), poly (decylene-dodecanoate), poly(undecylene-dodecanoate), poly(ododecylene-dodecanoate), poly(ethylene-fumarate), poly(propylene-fumarate), poly(butylene-fumarate), poly (pentylene-fumarate), poly(hexylene-fumarate), poly(octylene-fumarate), poly(nonylene-fumarate), poly(decylene-fumarate), poly(undecylene-fumarate), poly(ododecylene-fumarate), copoly-(butylene-fumarate)-copoly-(hexylene-fumarate), copoly-(ethylene-dodecanoate)-copoly-(ethylene-fumarate), mixtures thereof, and the like. The crystalline resin may be derived from monomers selected from, for example, organic diols and diacids in the presence of a polycondensation catalyst.

The crystalline resin may be present in an amount of from about 3 to about 20 percent by weight of the core, such as from about 5 to about 15 percent by weight or from about 5 to about 10 percent by weight of the core. The shell is substantially free of crystalline polyester.

The crystalline resin can possess a melting point of, for example, from at least about 60° C., such as from about 70° C. to about 80° C., and a number average molecular weight (Mn), as measured by gel permeation chromatography (GPC) of from about 1,000 to about 50,000, or from about 2,000 to about 25,000, with a weight average molecular weight (Mw) as determined by GPC using polystyrene standards of from about 2,000 to about 100,000, or from about 3,000 to about 80,000. The molecular weight distribution (Mw/Mn) of the crystalline resin is from about 2 to about 6, such as from about 2 to about 4.

The crystalline resin may be prepared by a polycondensation process involving reacting an organic diol and an organic diacid in the presence of a polycondensation catalyst. Generally, a stoichiometric equimolar ratio of organic diol and organic diacid is utilized. However, in some instances wherein the boiling point of the organic diol is from about 180° C. to about 230° C., an excess amount of diol can be utilized and removed during the polycondensation process. Additional amounts of acid may be used to obtain a high acid number for the resin, for example an excess of diacid monomer or anhydride may be used. The amount of catalyst utilized varies, and can be selected in an amount, for example, of from about 0.01 to about 1 mole percent of the resin.

Examples of organic diols for the preparation of crystalline polyester are the same as those used for the preparation of the amorphous polyester resin. Examples of organic diacids or diesters selected for the preparation of the crystalline resins are the same as those used for the preparation of amorphous polyester resin as disclosed above.

Polycondensation catalyst examples for the preparation of crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In embodiments, the core portion and/or shell portion of the toners may also contain at least one colorant. Colorants as used herein refers to, for example, pigment, dye, mixtures of pigment and dye, mixtures of pigments, mixtures of dyes, and the like. In embodiments, the colorant comprises a pigment, a dye, mixtures thereof, carbon black, magnetite, black, cyan, magenta, yellow, red, green, blue, brown, mixtures thereof, in an amount of about 1 percent to about 25 percent by weight based upon the total weight of the toner composition, such as from about 2 weight percent to about 20 weight percent or from about 5 weight percent to about 15 weight percent based upon the total weight of the toner composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhirich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871 K (BASF), Lithol Fast Scarlet IA300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lurnogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI 74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan, components may also be selected as pigments.

In embodiments, in the emulsion aggregation process, the core and shell portions of the toner particle may be formed by optionally including a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5 percent by weight or from about 0.01 to about 3 percent by weight of the toner particles. When coagulants are used, a metal sequestering agent may be necessary to remove any residual coagulant.

The latex emulsion from crystalline polyester resin may also be generated by the solvent flash process in a separate container. The latex emulsion may be formed by dissolving the polyester resin in an organic solvent, neutralizing the acid groups of the polyester resin with an alkali base, dispersing the resulting components with mixing in water, followed by heating to remove the organic solvent, thereby resulting in a latex emulsion.

Any suitable organic solvent may be used to dissolve the polyester resin, for example, including alcohols, esters, ethers, ketones and amines, such as ethyl acetate in an amount of, for example, about 1 weight percent to about 25 weight percent, such as about 10 weight percent resin to solvent weight ratio.

The acid groups of the polyester resin may be neutralized with an alkali base. Suitable alkali bases include, for example, sodium hydroxide, potassium hydroxide, lithium hydroxide, ammonium hydroxide, sodium bicarbonate, sodium carbonate, lithium carbonate, lithium bicarbonate, potassium bicarbonate, and potassium carbonate. The alkali base is selected in an amount to fully neutralize the acid. Complete neutralization is accomplished by measuring the pH of the emulsion, for example to have a pH of about 7.

In the emulsion, the seed particles of the polyester, can possess average diameter size of from about 10 to about 500 nanometers, such as from about 10 to about 400 nanometers, such as from about 50 to about 250 nanometers.

In embodiments, the toner particles are prepared via an emulsion aggregation process. In this process, at least the amorphous polyester and the crystalline polyester are mixed in emulsion form. The optional components of the core may also be included in the emulsion, for example, the wax, for example, the resin/wax composition, the colorant and the like. A coagulant may be added and the pH lowered from about 6.7 to about 7 to about 3.6 to about 4, for example, with dilute acid. The mixture is then sheared with a homogenizer, heated to a temperature of from about 35° C. to about 55° C., such as from about 40° C. to about 48° C., thereby generating a core aggregated to an average size of from about 4 microns to about 10 microns in diameter, such as from about 4 microns to about 8 microns. After the core is aggregated, more of the amorphous polyester emulsion is added, for example with or without wax and or colorant and without any crystalline polyester, and heating is continued to from about 40° C. to about 55° C., such as from about 45° C. to about 50° C., thereby generating a shell upon the core and forming a core/shell composite having an average size of from about 5 microns to about 12 microns, such as from about 5 microns to about 9 microns.

The size may be frozen (that is, further aggregation halted) by adding an alkaline base, such as sodium hydroxide or ammonium, until a pH of from about 6.3 to about 9, such as from about 7 to about 8.5, is achieved and optionally adding a metal sequestering agent such as ethylenediamine-tetracetic acid (tetra sodium salt). The aggregate composite may then be heated to a temperature below the onset melting point of the crystalline resin to coalesce (shape) the particles. The pH of the mixture may be decreased from about 6.3 to about 9 to from about 5.7 to about 6.3 with acid or buffer to during coalescing. The process may conclude with cooling, washing and drying the toner product.

The obtained particles comprise a core including crystalline polyester and a shell substantially free of crystalline polyester.

In embodiments, the polyester resin is emulsified in water without surfactant, for example by utilizing an alkali base such as sodium hydroxide. The carboxylic acid groups of the polyester are ionized to the sodium (or other metal ion) salt and self stabilize when prepared by a solvent flash process. In other embodiments, an anionic surfactant may be added to control the particle size of the emulsion.

EXAMPLES

The present invention is described below by referring to the Examples, however, the present invention is not limited thereto.

Preparation of Resin and Wax Emulsion A.

134.5 grams of polypropoxylated bisphenol A fumarate resin having an acid number of about 16.7 as measured by titration with KOH, weight average and number average molecular weight of 12,000 and 4,200 respectively as measured by DSC and onset glass transition temperature of about 56° C. as measured by DSC and 15.5 grams of carnauba wax are measured into a 2 liter beaker containing about 1100 grams of ethyl acetate. The mixture is stirred at about 250 revolutions per minute and heated to about 72° C. to dissolve the resin and wax in the ethyl acetate. 3.6 grams of concentrated ammonium hydroxide is measured into a 4 liter Pyrex glass flask reactor containing about 708 grams of deionized water and heated to about 68° C. Homogenization of said heated water solution in said 4 liter glass flask reactor is commenced with a IKA Ultra Turrax T50 homogenizer at 4,000 revolutions per minute. The heated resin and wax solution is then slowly poured into the water solution as the mixture continues to be homogenized, the homogenizer speed is increased to 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of said mixture is increased to 80° C. at about 1° C. per minute to distill off the ethyl acetate from the mixture. Stirring of the said mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. This is referred to as "latex (A)". The resulting resin emulsion is comprised of about 18 percent by weight solids in water as measured gravimetrically, and has a volume average diameter of about 186 nanometers as measured with a HONEYWELL MICROTRAC® UPA150 particle size analyzer. The onset glass transition temperature is about 53° C. and a melting point of about 81° C. as measured by DSC.

Preparation of Resin and Wax Emulsion B.

135.2 grams of polypropoxylated bisphenol A fumarate resin having an acid number of about 16.7 as measured by titration with KOH, weight average and number average molecular weight of 12,000 and 4,200 respectively as measured by DSC and onset glass transition temperature of about 56° C. as measured by DSC and 24.5 grams of carnauba wax are measured into a 2 liter beaker containing about 1100 grams of ethyl acetate. The mixture is stirred at about 250 revolutions per minute and heated to about 72° C. to dissolve the resin and wax in the ethyl acetate. 3.6 grams of concentrated ammonium hydroxide is measured into a 4 liter Pyrex glass flask reactor containing about 708 grams of deionized water and heated to about 68° C. Homogenization of said heated water solution in said 4 liter glass flask reactor is commenced with a IKA Ultra Turrax T50 homogenizer at 4,000 revolutions per minute. The heated resin and wax solution is then slowly poured into the water solution as the mixture continues to be homogenized, the homogenizer speed is increased to 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of said mixture is increased to 80° C. at about 1° C. per minute to distill off the ethyl acetate from the mixture. Stirring of the said mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. This is referred to as "latex (B)". The resulting resin emulsion is comprised of about 18 percent by weight solids in water as measured gravimetrically, and has a volume average diameter of about 195 nanometers as measured with a HONEYWELL MICROTRAC® UPA150 particle size analyzer. The onset glass transition temperature is about 51° C. and a melting point of about 80° C. as measured by DSC.

Preparation of Resin Emulsion C.

125 grams of polypropoxylated bisphenol A fumarate resin having an acid number of about 16.7 as measured by titration with KOH, weight average and number average molecular weight of 12,000 and 4,200 respectively as measured by DSC and onset glass transition temperature of about 56° C. as measured by DSC is measured into a 2 liter beaker containing about 917 grams of ethyl acetate. The mixture is stirred at about 250 revolutions per minute and heated to about 67° C. to dissolve the resin in the ethyl acetate. 3.05 grams of sodium bicarbonate are measured into a 4 liter Pyrex glass flask reactor containing about 708 grams of deionized water and heated to about 65° C. Homogenization of said heated water solution in said 4 liter glass flask reactor is commenced with a IKA Ultra Turrax T50 homogenizer at 4,000 revolutions per minute. The heated resin solution is then slowly poured into the water solution as the mixture continues to be homogenized, the homogenizer speed is increased to 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of said mixture is increased to 80° C. at about 1° C. per minute to distill off the ethyl acetate from the mixture. Stirring of the said mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. This is referred to as "latex (C)". The resulting resin emulsion is comprised of about 18 percent by weight solids in water as measured gravimetrically, and has a volume average diameter of about 143 nanometers as measured with a HONEYWELL MICROTRAC® UPA150 particle size analyzer. The onset glass transition temperature is about 56° C. as measured by DSC.

Preparation of Crystalline Polyester Resin.

A one liter Parr reactor equipped with a heating mantle, mechanical stirrer, bottom drain valve, and distillation apparatus was charged with dodecanedioic acid (443.6 grams), fumaric acid (18.6 grams), hydroquinone (0.2 gram), n butylstannoic acid (FASCAT 4100) catalyst (0.7 gram), and ethylene glycol (248 grams). The materials were stirred and slowly heated to 150° C. over 1 hour under a stream of CO2. The temperature was then increased by 15° C., and subsequently at 10° C. intervals, every 30 minutes, to 180° C. During this time, water was distilled as a byproduct. The temperature was then increased by 5° C. intervals, over a 1 hour period, to 195° C. The pressure was then reduced to 0.03 mbar over a 2 hour period, and any excess glycols were collected in the distillation receiver. The resin was returned to atmospheric pressure under a stream of CO2, and then trimellitic anhydride (12.3 grams) was added. The pressure was slowly reduced to 0.03 mbar over 10 minutes, and held there for another 40 minutes. The obtained crystalline resin, copoly(ethylene-dodecanoate)-copoly-(ethylene-fumarate), was returned to atmospheric pressure, and then drained through the bottom drain valve to give a resin with a viscosity of 87 Pa·s (measured at 85° C.), an onset melting of 69° C., melt point temperature peak of 78° C., and recrystallization peak on cooling of 56° C. as measured by the DuPont Differential Scanning Calorimeter. The acid value of the resin was found to be 12 meq/KOH.

Preparation of Crystalline Polyester Emulsion D.

816.67 Grams of ethyl acetate were added to 125 grams of the above prepared crystalline polyester resin. This resin was dissolved in a suitable solvent by heating to 65° C. on a hot plate and stirring at about 200 rpm. In a separate 4 liter glass reactor vessel were added 4.3 grams of a Tayca Power surfactant (47 weight percent aqueous solution), 2.2 grams, acid number of approximately 12 meq/KOH, of sodium bicarbonate and 708.33 grams of deionized water. This aqueous solution was heated to 65° C. on a hot plate with stirring at about 200 rpm. The dissolved resin in the ethyl acetate mixture was slowly poured into the 4 liter glass reactor containing the above aqueous solution with homogenization at 4,000 rpm. The homogenizer speed was then increased to 10,000 rpm and left for 30 minutes. The homogenized mixture was placed in a heat jacketed Pyrex distillation apparatus with stirring at about 200 rpm. The temperature was then increased to 80° C. at about 1° C./minute, and the ethyl acetate was distilled from the mixture at 80° C. for 120 minutes. The mixture attained was cooled to below 40° C. then screened through a 20 micron screen, and the pH was adjusted to 7 using a 4 weight percent NaOH aqueous solution and centrifuged. This is referred to as "latex (D)". The resulting resin was comprised of 17.9 weight percent solids by weight in water with a volume average diameter of about 203 nanometers as measured with a Honeywell UPA150 particle size analyzer.

Example 1

In a 2 L reactor vessel were added 595.27 grams of a latex A, 87.48 grams of latex D, 63.48 grams of cyan pigment PB 15:3 having a solids loading of 17 weight %, 2 grams of Dowfax 2A1 surfactant having a solids loading of 47.68 weight %, 123 grams of 0.3M HNO3, and 395 grams of deionized water and stirred using an IKA Ultra Turrax®T50 homogenizer operating at 4,000 rpm. Thereafter, 36 grams of a flocculent mixture containing 3.6 grams polyaluminum chloride mixture and 32.4 grams of a 0.02 molar (M) nitric acid solution was added dropwise over a period of 5 minutes. As the flocculent mixture was added drop-wise, the homogenizer speed was increased to 5,200 rpm and homogenized for an additional 5 minutes. Thereafter, the mixture was heated at a 1° C. per minute temperature increase to a temperature of 41° C. and held there for a period of about 1.5 to about 2 hours resulting in a volume average particle diameter of 5 microns as measured with a Coulter Counter. During the heat up period, the stirrer was run at about 450 rpm. An additional 280 grams latex A, 75 grams of deionized water, and 10 grams of 0.3M HNO3 was added to the reactor mixture and allowed to aggregate for an additional period of about 30 minutes at which time the reactor temperature was increased to 49° C. resulting in a volume average particle diameter of about 5.7 microns. The pH of the reactor mixture was adjusted to 6 with a 1.0 M sodium hydroxide solution, followed by the addition of 1.048 grams of Versene 100. The reactor mixture was then heated at a temperature increase of 1° C. per minute to a temperature of 68° C. The pH of the mixture was then adjusted to 6.0 with a 0.3 M nitric acid solution. The reactor mixture was then gently stirred at 68° C. for about 6 hours to coalesce and spherodize the particles. The reactor heater was then turned off and the mixture was allowed to cool to room temperature at a rate of 1° C. per minute. The toner had a volume average particle diameter of about 5.7 microns, and a grain size distribution (GSD) of about 1.24. The particles were washed 5 times, the first wash being conducted at pH 9 at 23° C., followed by 1 washes with deionized water at room temperature, followed by one wash at pH 4.0 at 40° C., and 2 additional washes with deionized water at room temperature.

Example 2

In a 2 L reactor vessel were added 595.27 grams of a latex B, 87.48 grams of latex D, 63.48 grams of cyan pigment PB 15:3 having a solids loading of 17 weight %, 2 grams of Dowfax 2A1 surfactant having a solids loading of 47.68 weight %, 123 grams of 0.3M HNO3, and 395 grams of deionized water and stirred using an IKA Ultra Turrax®T50 homogenizer operating at 4,000 rpm. Thereafter, 36 grams of a flocculent mixture containing 3.6 grams polyaluminum chloride mixture and 32.4 grams of a 0.02 molar (M) nitric acid solution was added dropwise over a period of 5 minutes. As the flocculent mixture was added drop-wise, the homogenizer speed was increased to 5,200 rpm and homogenized for an additional 5 minutes. Thereafter, the mixture was heated at a 1° C. per minute temperature increase to a temperature of 41° C. and held there for a period of about 1.5 to about 2 hours resulting in a volume average particle diameter of 5 microns as measured with a Coulter Counter. During the heat up period, the stirrer was run at about 450 rpm. Additionally added are 280 grams latex C, 75 grams of deionized water, and 10 grams of 0.3M HNO3 was added to the reactor mixture and allowed to aggregate for an additional period of about 30 minutes at which time the reactor temperature was increased to 49° C. resulting in a volume average particle diameter of about 5.7 microns. The pH of the reactor mixture was adjusted to 6 with a 1.0 M sodium hydroxide solution, followed by the addition of 1.048 grams of Versene 100. The reactor mixture was then heated at a temperature increase of 1° C. per minute to a temperature of 68° C. The pH of the mixture was then adjusted to 6.0 with a 0.3 M nitric acid solution. The reactor mixture was then gently stirred at 68° C. for about 6 hours to coalesce and spherodize the particles. The reactor heater was then turned off and the mixture was allowed to cool to room temperature at a rate of 1° C. per minute. The toner had a volume average particle diameter of about 5.7 microns, and a grain size distribution (GSD) of about 1.24. The particles were washed 5 times, the first wash being conducted at pH 9 at 23° C., followed by 1 washes with deionized water at room temperature, followed by one wash at pH 4.0 at 40° C., and 2 additional washes with deionized water at room temperature.

Example 3

The same processes as those of Example 1 were carried out except that the cyan pigment was replaced with 70 grams of black pigment Regal 330 having a solids loading of 17 weight %.

Example 4

The same processes as those of Example 1 were carried out except that the cyan pigment was replaced with 74 grams of yellow pigment PY74 having a solids loading of 17 weight %.

Example 5

The same processes as those of Example 1 were carried out except that the cyan pigment was replaced with 55 grams of red pigment PR122 having a solids loading of 17 weight % and 55 grams of red pigment PR 238 having a solids loading of 17 weight %.

Example 6

The same processes as those of Example 2 were carried out except that the cyan pigment was replaced with 70 grams of black pigment Regal 330 having a solids loading of 17 weight %.

Example 7

The same processes as those of Example 2 were carried out except that the cyan pigment was replaced with 74 grams of yellow pigment PY74 having a solids loading of 17 weight %.

Example 8

The same processes as those of Example 2 were carried out except that the cyan pigment was replaced with 55 grams of red pigment PR122 having a solids loading of 17 weight % and 55 grams of red pigment PR 238 having a solids loading of 17 weight %.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for forming particles comprising:

generating a first emulsion comprised of an amorphous polyester resin and wax, generating a second emulsion comprised of a crystalline polyester resin, adding the colorant and an optional coagulant to the first emulsion, second emulsion or combined first and second emulsions, aggregating the first emulsion, the second emulsion and a colorant to form core particles, reducing the pH to a range of from about 3.3 to about 3.9 with an acid; shearing; and heating to a temperature of from about 35° C. to about 55° C., adding an additional quantity of the first emulsion with or without the colorant to the core particles and forming a shell on the core particles, and coalescing the particles.

2. The process of claim 1, wherein the generating of a first emulsion comprises dissolving a first polymer and a wax in an organic solvent to form a solution, mixing the solution with an emulsion medium into an emulsion and heating the emulsion to flash off the solvent.

3. The process of claim 1, wherein the generating of a first emulsion additionally comprises a surfactant.

4. The process of claim 1, where the acid is selected from the group consisting of nitric acid, hydrochloric acid and sulfuric acid.

5. The process of claim 1, wherein the forming a shell on the core particles comprises heating to a temperature of from about 45° C. to about 50° C.; adding a base to raise the pH to from about 6.3 to about 9 and optionally adding a metal sequestering agent to freeze the size of the core/shell particles.

6. The process of claim 1, wherein the coalescing the particles comprises:

heating the core/shell particles to a temperature below the melting point of the crystalline polyester resin; and decreasing the pH of the mixture from about 6.3 to about 9 to about 5.7 to about 6.3.

7. The process of claim 1, further comprising adding a wax to the toner in the amount of from about 3% to about 20% by weight of the toner.

8. The process of claim 1, further comprising adding the colorant in the amount of from about 2% to about 15% by weight of the toner.

9. The process according to claim 1, wherein the first emulsion is substantially free of a surfactant.

10. The process according to claim 1, wherein the second emulsion is substantially free of a surfactant.

11. A process for forming particles comprising:

generating a first emulsion of an amorphous polyester resin and a wax by dissolving the first polyester and the wax in an organic solvent to form a solution, mixing the solution with an emulsion medium into an emulsion and heating the emulsion to flash off the solvent, generating a second emulsion of a crystalline polyester resin, adding a colorant, aggregating the first emulsion, the second emulsion and the colorant to form core particles by:

optionally adding a coagulant, reducing the pH to a range of from about 3.3 to about 3.9 with an acid; shearing; heating to a temperature of from about 35° C. to about 55° C., adding an additional quantity of the first emulsion to the core particles and forming a shell on the core particles by heating to a temperature of from about 45° C. to about 50° C.; adding a base to raise the pH to from about 6.3 to about 9 and optionally adding a metal sequestering agent to freeze the size of the aggregate;

coalescing the particles by heating said aggregate to a temperature below the melting point of the crystalline polyester; and decreasing the pH of the mixture from about 6.3 to about 9 to from about 5.7 to about 6.3;

cooling, washing and drying.

12. An emulsion aggregation toner having a core portion and a shell portion, wherein the core portion comprises an amorphous polyester resin, a wax, a colorant and a crystalline polyester resin, and wherein the shell portion comprises the amorphous polyester resin and is substantially free of crystalline polyester resin, and wherein the shell portion has a melting point of from about 50° C. to about 100° C., wherein the crystalline polyester resin comprises from about 3 weight percent to about 20 weight percent of the toner, and wherein the amorphous polyester resin from about 35 weight percent to about 90 weight percent of the toner.

13. The toner of claim 12, wherein the shell portion further includes a wax.

14. The toner of claim 12, wherein the amorphous polyester resin is a linear amorphous polyester resin.

15. The toner of claim 12, wherein the colorant comprises from about 2 weight percent to about 15 weight percent of the toner.

16. The toner of claim 12, wherein the wax comprises from about 3 weight percent to about 20 weight percent of the toner.

17. The toner of claim 12, wherein the RH sensitivity ratio of the toner is from about 1 to about 2.

* * * * *